US008499942B1

(12) United States Patent
Coretti, Jr. et al.

(10) Patent No.: US 8,499,942 B1
(45) Date of Patent: Aug. 6, 2013

(54) REINFORCEMENT SYSTEM FOR AN EXTRA-WIDE DISPLAY SHELF

(75) Inventors: Joseph Coretti, Jr., Wheaton, IL (US); Scott R. Hammac, Joliet, IL (US); Tracy M. Groholski, Mount Prospect, IL (US)

(73) Assignee: B-O-F Corporation, Aurora, IL (US)

( * ) Notice: Subject to any disclaimer, the term of this patent is extended or adjusted under 35 U.S.C. 154(b) by 0 days.

(21) Appl. No.: 13/570,804

(22) Filed: Aug. 9, 2012

(51) Int. Cl.
*A47F 1/04* (2006.01)
*A47F 5/00* (2006.01)
*A47F 5/14* (2006.01)

(52) U.S. Cl.
USPC ..... 211/59.2; 211/134; 211/189; 211/181.1

(58) Field of Classification Search
USPC ..... 211/134, 186, 187, 188, 189, 190, 211/181.1, 133.5, 153, 183; 108/163, 181, 108/147.11–147.17; 312/408, 410
See application file for complete search history.

(56) References Cited

U.S. PATENT DOCUMENTS

| | | | | | |
|---|---|---|---|---|---|
| 1,375,869 | A | * | 4/1921 | Vance | 108/109 |
| 2,066,303 | A | | 12/1936 | Schulz | |
| 3,137,249 | A | | 6/1964 | Postula et al. | |
| 3,523,508 | A | | 8/1970 | Maslow | |
| 4,064,994 | A | * | 12/1977 | Ondrasik, II | 211/153 |
| 4,250,815 | A | * | 2/1981 | Swanson | 108/108 |
| 4,331,243 | A | * | 5/1982 | Doll | 211/59.2 |
| 4,492,169 | A | * | 1/1985 | Ware et al. | 108/6 |
| 4,597,616 | A | | 7/1986 | Trubiano | |
| 5,072,839 | A | | 12/1991 | Arnone | |
| 5,390,803 | A | | 2/1995 | McAllister | |
| D375,860 | S | * | 11/1996 | Coretti et al. | D6/566 |
| 5,607,068 | A | | 3/1997 | Coretti, Jr. et al. | |
| 5,992,651 | A | | 11/1999 | Shaw et al. | |
| 6,044,983 | A | * | 4/2000 | Hall | 211/59.2 |
| 6,267,258 | B1 | | 7/2001 | Wilkerson et al. | |
| 6,273,276 | B1 | * | 8/2001 | Upton et al. | 211/59.2 |
| 6,286,693 | B1 | * | 9/2001 | Brown | 211/181.1 |
| 6,299,001 | B1 | | 10/2001 | Frolov et al. | |
| 6,317,981 | B1 | * | 11/2001 | Clive-Smith | 29/897.35 |
| 6,332,547 | B1 | | 12/2001 | Shaw et al. | |
| D477,957 | S | * | 8/2003 | Mikich et al. | D6/574 |
| 7,007,815 | B2 | * | 3/2006 | Anderson et al. | 211/191 |
| 7,181,924 | B2 | | 2/2007 | Duffy et al. | |
| 2006/0042522 | A1 | | 3/2006 | Trubiano | |

* cited by examiner

*Primary Examiner* — Jonathan Liu
*Assistant Examiner* — James Twomey
(74) *Attorney, Agent, or Firm* — Marshall, Gerstein & Borun LLP

(57) ABSTRACT

A system and method of reinforcement of an extra-wide display shelf for a gravity-fed display system. The shelf includes a front rail, a rear rail and two side rails disposed between the front rail and the rear rail, a plurality of cross-rails extending from the front rail to the rear rail parallel to and between the side rails, and a plurality of horizontal rails disposed under the plurality of cross-rails. The reinforcement system includes a plurality of support rails disposed under and perpendicular to the plurality of horizontal rails, and a plurality of reinforcement rails disposed perpendicular to and under the plurality of support rails. The reinforcement system puts the surface of the shelf in tension or otherwise bends a center region of the surface of the shelf upward when unloaded (or when free of product) to offset downward deflection due to weight of product to be displayed.

5 Claims, 6 Drawing Sheets

REINFORCEMENT SYSTEM FOR AN EXTRA-WIDE DISPLAY SHELF

FIELD OF THE DISCLOSURE

The disclosure relates generally to gravity-fed display systems, and, more specifically, to a reinforcement system for an extra-wide display shelf of a gravity-fed display system.

BACKGROUND OF THE DISCLOSURE

To increase inventory turnover and maximize efficient use of shelf space, retailers increasingly use gravity flow shelving systems or gravity-fed display systems, wherein inclined wire shelves are used to stock merchandise. Examples of such systems are disclosed in U.S. Pat. Nos. 5,992,651 and 6,332,547, both of which are owned by B-O-F Corporation of Aurora, Ill., the assignee of the present disclosure. As explained therein, in such systems consumers are presented with an array of merchandise arranged in parallel tracks on each shelf, generally with only the front-most unit of merchandise in each individual track being easily accessible. Upon removing this front-most unit of merchandise, the remaining units of like-merchandise in that particular track advance, i.e., slide down toward the front of the shelf, allowing the next-successive unit in line to become the new front-most unit in that track.

Because conventional flat merchandise shelves, e.g., cantilevered or so-called "gondola"-type shelves, allow users to rearrange product on the shelves, such as to find product with later expiration dates, these inclined gravity-fed display shelving systems help ensure that the oldest product is sold first. By making rearrangement of product more difficult, it is found that inventory waste is reduced. The inclined arrangement of the gravity-fed display shelves also allows greater shelf space on a given footprint of valuable floor space for a retailer, which is a particular advantage in relatively costly refrigerated aisles and wall units.

While the gravity-fed display systems referred to above are designed for single door refrigeration and dispenser units, there has been a recent movement to include gravity-fed display systems in refrigeration and dispenser units having double- or "French" doors opening at a middle section of the unit. To effectively include the gravity-fed display systems in such extra-wide, double door units, new extra-wide or double wide display shelves have been designed such that they can be disposed within the same.

Some of the new extra-wide wire-type display shelves have included vertical center supports extending from both a front and a rear portion of the shelf to a bottom portion of a rack of the unit. However, such center supports, while functional, are visible when the double doors of a unit are opened and, thus, are often not aesthetically pleasing. In addition, the front center supports, since off-set from the hinged panels between pairs of the glass doors, may obstruct access to some of the product displayed on the shelf, and thus interfere with the efficient use and benefits of the gravity-fed display systems. As such, it is desirable to provide extra-wide display shelves without such a center support. Without the center support, however, the center area of the extra-wide shelf deflects or bows downwardly after product is placed thereon, due to the weight of the product. The center area's downward deflection interferes with linear advancement of product toward the front of the shelf and, particularly in the case of relatively tall product containers, can result in product containers toppling over.

For conventional-width wire-type display shelves, such as on the order of 41 inches or less, while there may have been some downward deflection in the center area of the shelf due to weight of product, the deflection was not appreciable, and the product containers along the sides of the shelf were not spaced so far from the center of the shelf as to: (1) pose a risk of tipping over due to the minimal deflection; or (2) interfere with the smooth gravity-fed gliding of the product to the front of the unit. However, in the case of extra-wide wire-type display shelves having a width of more than 41 inches, the number and weight of product to be displayed thereon increases, particularly such as where heavy gallon size containers are being displayed (e.g., milk, juice), as does the downward deflection of the center area of the shelf and the distance of product along the sides of the shelf from the center of the shelf. As a result, it is desirable to provide a reliable technique for reinforcement of an extra-wide wire-type display shelf that does not require vertical center supports.

SUMMARY OF THE DISCLOSURE

A display shelf comprises a front rail, a rear rail disposed opposite the front rail, and two side rails disposed between the front rail and the rear rail. The display shelf further includes a plurality of cross-rails extending from the front rail, along the length of the front and rear rails, and a plurality of horizontal rails disposed under the plurality of cross-rails, each horizontal rail extending from one side rail to the other side rail. The plurality of cross-rails and the plurality of horizontal rails form a surface of the shelf that includes an underside, and a reinforcement system is then disposed on the underside of the shelf. The reinforcement system includes a plurality of support rails disposed perpendicular to and under the plurality of horizontal rails, wherein each support rail is welded to at least one horizontal rail and a plurality of reinforcement rails disposed perpendicular to and under the plurality of support rails along the length of the plurality of horizontal rails. Each reinforcement rail includes a first end, a second end disposed opposite the first end, and a middle section disposed between the first and second ends, wherein the first and second ends of the reinforcement rails are bent in one direction and welded to a corresponding horizontal rail and the middle sections of the reinforcement rails are welded to at least one support rail. The reinforcement system puts the surface of the shelf in tension or otherwise bends the surface of the shelf when unloaded such that the center region of the shelf bows in an upward direction to offset downward deflection of the center region of the shelf due to the weight of product to be displayed thereon.

The plurality of support rails may include a first support rail disposed at an approximate center of the surface of the shelf, a second support rail and a third support rail, wherein each of the second and third support rails are spaced the same distance from the first support rail on either side of the same.

In addition, the plurality of horizontal rails may include six horizontal rails.

Further, the plurality of reinforcement rails may include six reinforcement rails.

Still further, the number of horizontal rails may be equal to the number of reinforcement rails.

In one example, the shelf further comprises a second front rail disposed above the front rail, wherein a front end of the first support rail is bent in one direction and welded to the second front rail.

In this same example, the shelf further comprises a second rear rail disposed above the rear rail, wherein a rear end of the first support rail is bent in one direction and welded to the second rear rail.

In addition, the side rails may include a first side rail and a second side rail, the first side rail includes a front end and a rear end, wherein the front end is bent in one direction and welded to the front rail of the shelf and the rear end is bent in one direction and welded to the rear rail of the shelf.

Further, the second side rail of the shelf may include a front end and a rear end, and the front end may be bent in one direction and welded to the front rail and the rear end of the second side rail is bent in the same direction and welded to the rear rail of the shelf.

Still further, an L-shaped plate may be secured to each of the side rails to assist with positioning the shelf within a rack of the gravity-fed display system.

In another example of the disclosure, a gravity-fed display system comprises a rack having front support legs and rear support legs disposed opposite the front support legs and at least one display shelf disposed within the rack. The display shelf comprises a front rail, a rear rail disposed opposite the front rail, and two side rails disposed between the front rail and the rear rail. The shelf further comprises a plurality of cross-rails, wherein each cross-rail extends from the front rail to the rear rail parallel to and between the side rails, along the length of the front and rear rails, and a plurality of horizontal rails disposed under the plurality of cross-rails. Each horizontal rail extends from one side rail to the other side rail parallel to and between the front and rear rails, and the plurality of cross-rails and the plurality of the horizontal rails form a surface of the shelf. The shelf further comprises a reinforcement system disposed on an underside of the shelf. More specifically, the reinforcement system includes a plurality of support rails disposed perpendicular to and under the plurality of horizontal rails, wherein each support rail is welded to at least one horizontal rail and a plurality of reinforcement rails is disposed perpendicular to and under the plurality of support rails. Each reinforcement rail includes a first end, a second end disposed opposite the first end, and a middle section disposed between the first and second ends. In addition, the first and second ends of the reinforcement rails are bent in one direction and welded to one horizontal rail of the plurality of horizontal rails and the middle sections of the reinforcement rails are welded to at least one support rail. As such, the reinforcement system puts the surface of the shelf in tension or otherwise bends the surface of the shelf such that a center region of the shelf bows in an upward direction to offset downward deflection of the center region of the shelf due to weight of product to be displayed thereon.

In yet another example of the disclosure, a method of reinforcing a display shelf comprises disposing a plurality of support rails on an underside of a shelf and under a plurality of horizontal rails of the shelf, welding each support rail of the plurality of support rails to at least one horizontal rail of the plurality of horizontal rails, and disposing a plurality of reinforcement rails under the plurality of support rails. Each reinforcement rail includes a first end, a second end disposed opposite the first end, and a middle section disposed between the first and second ends. The method further comprises bending the first and second ends of each reinforcement rail in one direction, welding the first and second ends of each reinforcement rail to a corresponding horizontal rail of the plurality of horizontal rails, and welding the middle sections of each reinforcement rail to at least one support rail. In this manner, the shelf is put in tension or a center region of the shelf is otherwise bent in an upward direction to offset downward deflection of the center region of the shelf due to weight of product to be displayed thereon.

DETAILED DESCRIPTION OF THE DISCLOSURE

The present disclosure is directed generally to a reinforcement system for an extra-wide wire-type display shelf of a gravity-fed display system. As used herein, the term "extra-wide display shelf" refers to a shelf having a width of more than 41 inches (as compared to conventional retail gravity-fed shelves, such as for use in refrigeration and dispensing units, having widths in the order of 41 inches or less. The extra-wide display shelf includes front and rear rails and two side rails disposed between the same. The extra-wide display shelf further includes a plurality of cross-rails extending from the front rail to the rear rail and a plurality of horizontal rails disposed under and perpendicular to the plurality of cross-rails and parallel to the front and rear rails. The plurality of cross-rails and the plurality of horizontal rails form a surface of the extra-wide display shelf. The reinforcement system is disposed on an underside of the shelf and includes a plurality of support rails, which are disposed under and perpendicular to the plurality of horizontal rails, and a plurality of reinforcement rails, which are disposed under and perpendicular to the plurality of support rails. First and second ends of the reinforcement rails are bent in one direction and welded to a corresponding horizontal rail, and middle sections of the reinforcement rails are welded to at least one support rail. In this manner, the reinforcement system puts the shelf in tension or otherwise bends the shelf in an upward direction when unloaded to offset downward deflection of a center region of the shelf due to the weight of product to be displayed thereon.

Figure 1:
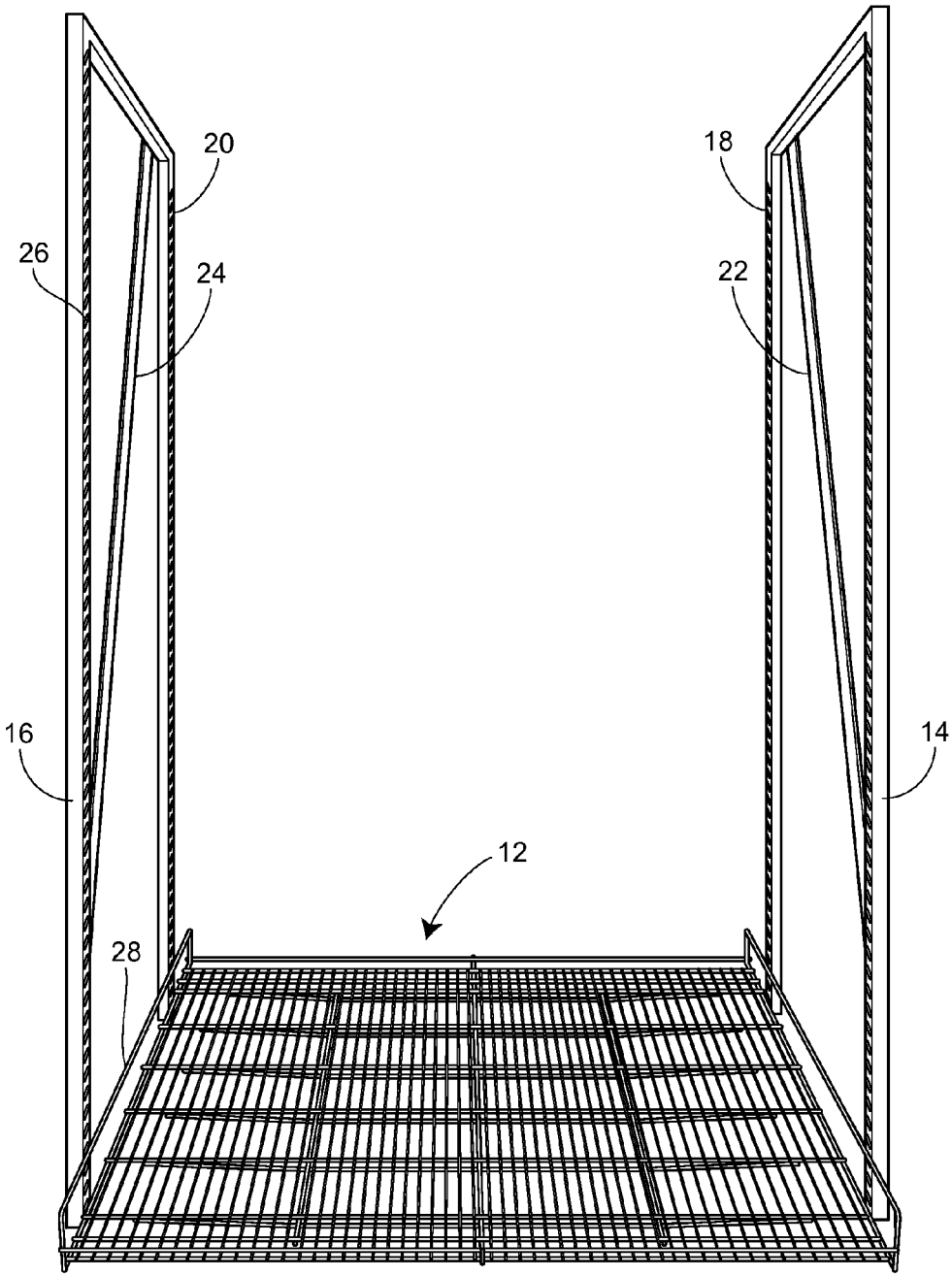
FIG. 1 is a front, perspective view of an example extra-wide rack of a gravity-fed display system illustrating an example extra-wide display shelf disposed therein.

Referring now to FIG. 1, a gravity-fed display system 10 is illustrated. More specifically, the gravity-fed display system 10 includes a, preferably metal, extra-wide rectangular rack 12 having two front support legs 14, 16 and two rear support legs 18, 20 disposed opposite the front support legs 14, 16.

The extra-wide rack 12 may further include two diagonal stabilizer support rack members 22, 24. To customize the assembly of the gravity-fed display system 10, each of the legs 14, 16, 18 and 20 is provided with holes 26, such as key holes, along its length. The holes 26 enable one or more extra-wide shelves 28 to be placed at any desired height and angle of incline along the legs 14, 16, 18 and 20 to maximize storage space, for example. The holes may be keyhole slots that receive clamps (not shown) as disclosed, for example, in U.S. Pat. No. 6,332,547.

Figure 2:
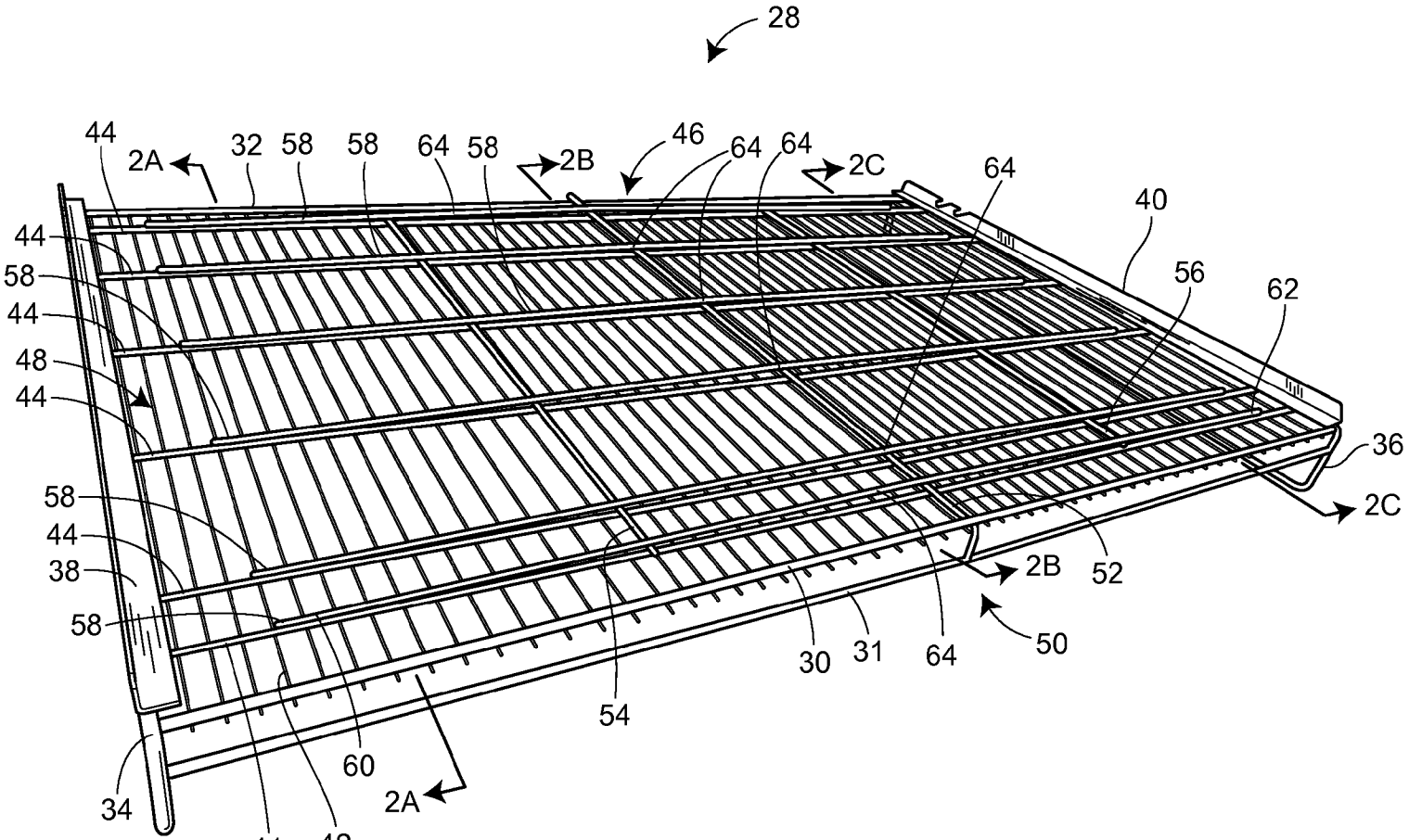
FIG. 2 is a bottom, perspective view of an example extra-wide display shelf with a reinforcement system constructed in accordance with the principles of the present disclosure.

Referring now to FIG. 2, a bottom view of the extra-wide shelf 28 is illustrated. The extra-wide shelf 28 includes a first front rail 30 and a second front rail 31 disposed adjacent to the first front rail 30. The shelf 28 also includes a first rear rail 32 and a second rear rail 33 (see, e.g., FIG. 2A) disposed adjacent to the first rear rail 32. Both the first and second rear rails 32, 33 are disposed opposite the first and second front rails 30, 31. The shelf 28 further includes two side rails: a first side rail 34 and a second side rail 36 disposed between the front rail 30 and the rear rail 32. Front and rear ends of the first and second side rails 34, 36 may be bent in one direction, such as an upward direction, such that the ends intersect the second front rail 31 at one end and the second rear rail 33 at the other end.

Figure 2A:
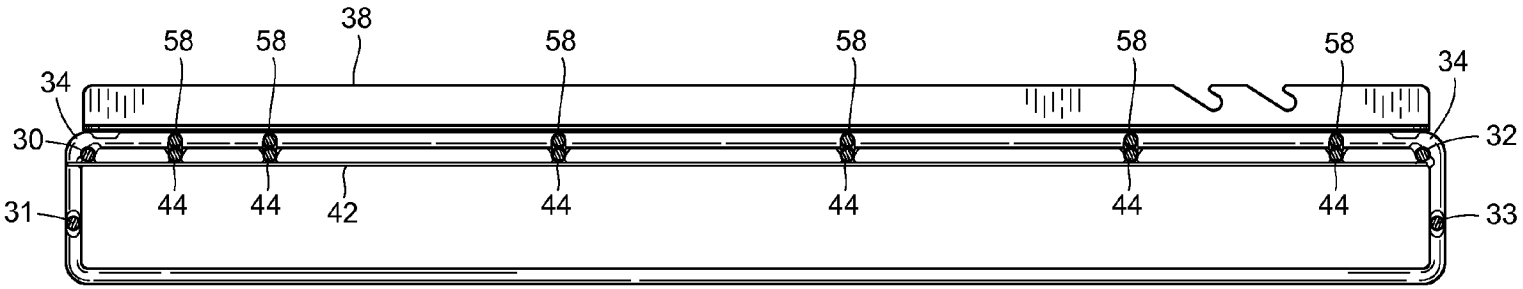
FIG. 2A is a cross-sectional view of a left side of the display shelf of FIG. 2, taken along the lines 2A-2A of FIG. 2.
Figure 2B:
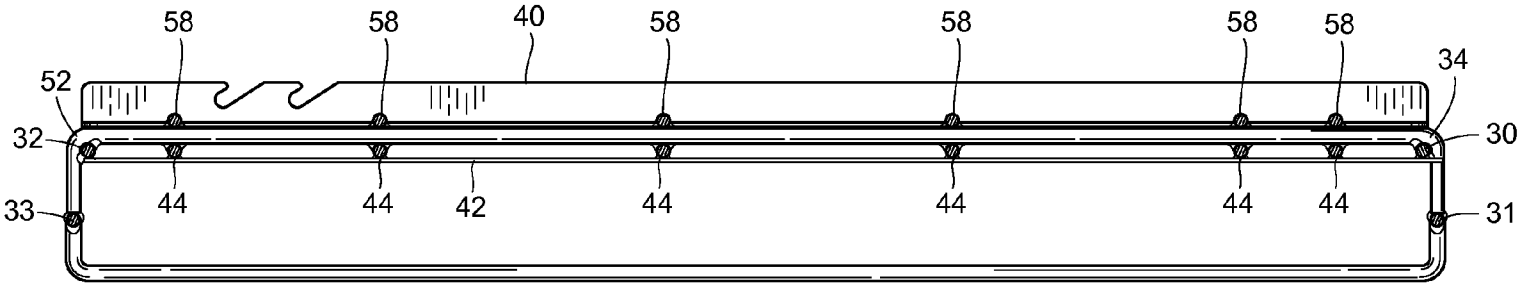
FIG. 2B is a cross-sectional view of a center area of the display shelf of FIG. 2, taken along the lines 2B-2B of FIG. 2.
Figure 2C:
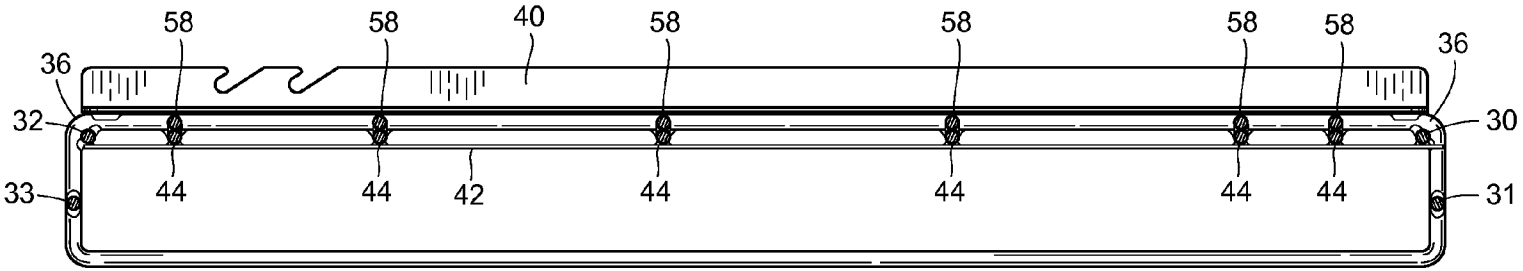
FIG. 2C is a cross-sectional view of a right side of the display shelf of FIG. 2, taken along the lines 2C-2C of FIG. 2.

More specifically, and referring in particular to FIGS. 2A and 2C, in one example, the first side rail 34 of the shelf 28 includes a front end and a rear end. The front end is bent in one direction, such as an upward direction, and welded to the second front rail 31, as illustrated in FIGS. 2 and 2A. As further illustrated in FIG. 2A, the rear end of the first side rail 34 may also be bent in the same direction, such as an upward direction, and welded to the second rear rail 33 of the shelf 28. Likewise, and as illustrated in FIG. 2C, the second side rail 36 also includes a front end and a rear end. The front end may also be bent in one direction, such as an upward direction, and welded to the second front rail 31, and the rear end of the second side rail 36 may also be bent in the same direction, such as an upward direction, and welded to the second rear rail 33.

As further illustrated in FIGS. 2 and 2A, an L-shaped plate 38 is adhered to the first side rail 34 to assist with positioning and securing the extra-wide shelf 28 within the extra-wide rack 12 of the gravity-fed display system 10. In a similar manner, and as also illustrated in FIGS. 2 and 2C, another L-shaped plate 40 is adhered to the second side rail 36 to further assist with positioning and securing the extra-wide shelf 28 within the extra-wide rack 12 of the gravity-fed display system 10.

The extra-wide shelf 28 further includes a plurality of cross-rails 42 disposed between the first front and rear rails 30, 32 and parallel to the first and second side rails 34, 36 of the shelf. More specifically, an end of each cross-rail of the plurality of cross-rails 42 extends from the first front rail 30 to the first rear rail 32 along the length of the first front and rear rails 30, 32. The extra-wide shelf 28 also includes a plurality of horizontal rails 44 disposed under the plurality of cross-rails 42 and between the first front and rear rails 30, 32. Each horizontal rail 44 of the plurality of horizontal rails extends from the first side rail 34 to the second side rail 36, parallel to the front and rear rails 30, 32 of the shelf 28.

In one example, and as also illustrated in FIG. 2, for example, the plurality of horizontal rails 44 includes six horizontal rails 44 disposed between and parallel to the first front and rear rails 30, 32. While six horizontals rails are illustrated, fewer or more horizontal rails may be included in the plurality of horizontal rails 44, depending upon the depth of the extra-wide display shelf 28, without departing from the scope of the present disclosure.

In addition, and as further illustrated in FIG. 2, both the plurality of cross-rails 42 and the plurality of horizontal rails 44 may include cylindrical wire members and, in one example, the diameter of each cross-rail is less than the diameter of each horizontal rail. Further, the extra-wide display shelf 28 may be painted, dipped, or otherwise covered with a coating, making the extra-wide display shelf 28 both more aesthetic and easier to clean, for example.

Together, the plurality of horizontal rails 44 and the plurality of cross-rails 42 form a surface 45 (FIG. 6) of the shelf 28 for receiving a variety of containers, such as dairy products including, but not limited to, gallons of milk and tubs of yogurt. The surface 45 of the shelf includes an underside 46, as illustrated in FIG. 2, for example, to which a reinforcement system 48 of the present disclosure is secured.

Still referring to FIG. 2, the reinforcement system 48 includes a plurality of support rails 50 disposed under and perpendicular to the plurality of horizontal rails 44. More specifically, each support rail of the plurality of support rails 50 is welded to at least one horizontal rail 44 of the plurality of horizontal rails 44, as explained in more detail below. In one example, the plurality of support rails 50 includes a first or center support rail 52 disposed in the center of the shelf 28, midway between the first side rail 34 and the second side rail 36 and the first front and rear rails 30, 32. One end of the first support rail 52 is welded to the first front rail 30 of the shelf 28, and a second end of the first support rail 52 is welded to the first rear rail 32 of the shelf 28 (not shown). In another example, and as illustrated in FIG. 2B, the ends of the first support rail 52 may be bent in one direction, such as an upward direction, such that the ends attach to the second front rail 31 of the shelf 28 and the second rear rail 33 disposed opposite the second front rail 31 of the shelf 28.

In addition to the first support rail 52, the plurality of support rails 50 may further include a second support rail 54 and a third support rail 56, such that each of the second and third support rails 54, 56 are spaced the same distance from the first support rail 52 on either side of the first support rail 52. In one example, the front ends of the second and third support rails 54, 56 are welded to one of the plurality of horizontal rails 44 disposed near the front rail 30. In a similar manner, the rear ends of the second and third support rails 54, 56 are welded to one of the plurality of horizontal rails 44 disposed near the rear rail 32 of the shelf 28.

The reinforcement system 48 further includes a plurality of reinforcement rails 58 disposed perpendicular to and under the plurality of support rails 50. Each reinforcement rail 58 includes a first end 60, a second end 62 disposed opposite the first end 60, and a middle section 64 disposed between the first and second ends 60, 62. The first and second ends 60, 62 are bent in a direction, such as an upward direction, and welded to a corresponding horizontal rail 44. In addition, the middle sections 64 of the reinforcement rails 58 are welded to at least one support rail 50 of the plurality of support rails 50.

Figure 3:
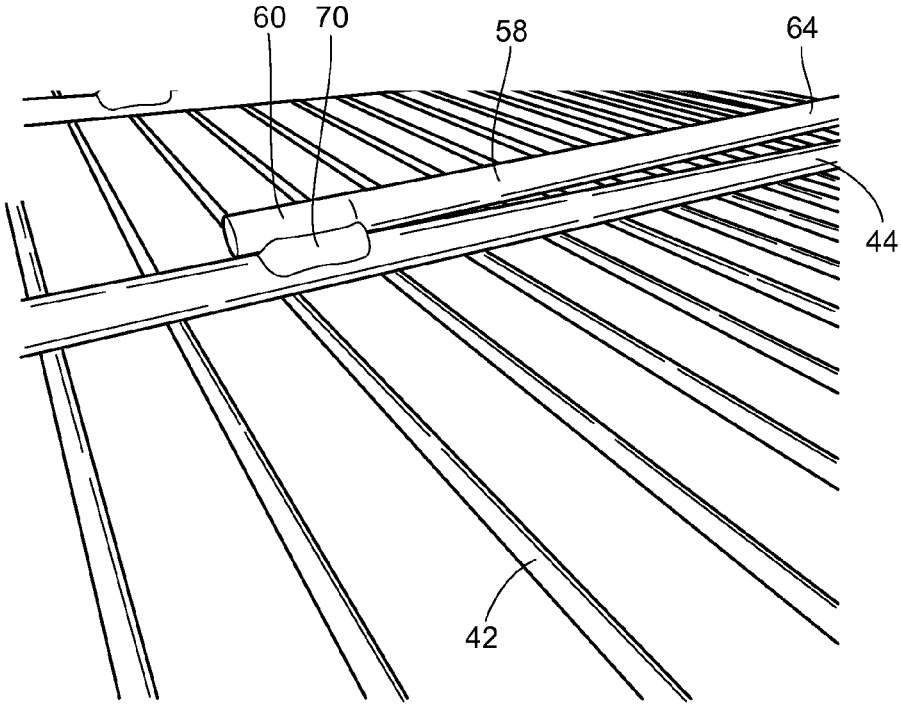
FIG. 3 is a perspective view of a weld connecting a reinforcement rail end of the reinforcement system to a horizontal rail of the extra-wide display shelf.

Referring now to FIG. 3, an enlarged, perspective view of an end weld 70 that connects the first end 60 of one reinforcement rail 58 of the plurality of reinforcement rails to one horizontal rail 44 of the extra-wide shelf 28 is illustrated. While illustrated as connecting only one reinforcement rail 58 to one horizontal rail 44, one will appreciate that the same end weld 70 connects each end of each reinforcement rail 58 to the corresponding horizontal rail 44 to which the reinforcement rail 44 is disposed under, as illustrated in FIG. 2.

Figure 4:
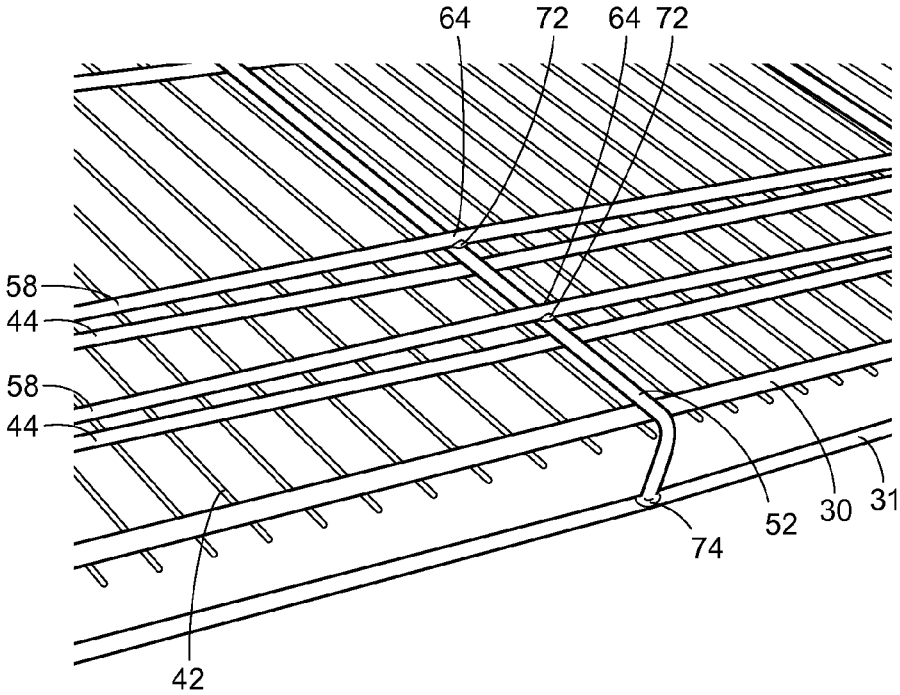
FIG. 4 is a perspective view of two center welds of the reinforcement system of the present disclosure, the center welds connecting middle sections of two reinforcement rails to a first support rail of a plurality of support rails of the reinforcement system.
Figure 5:
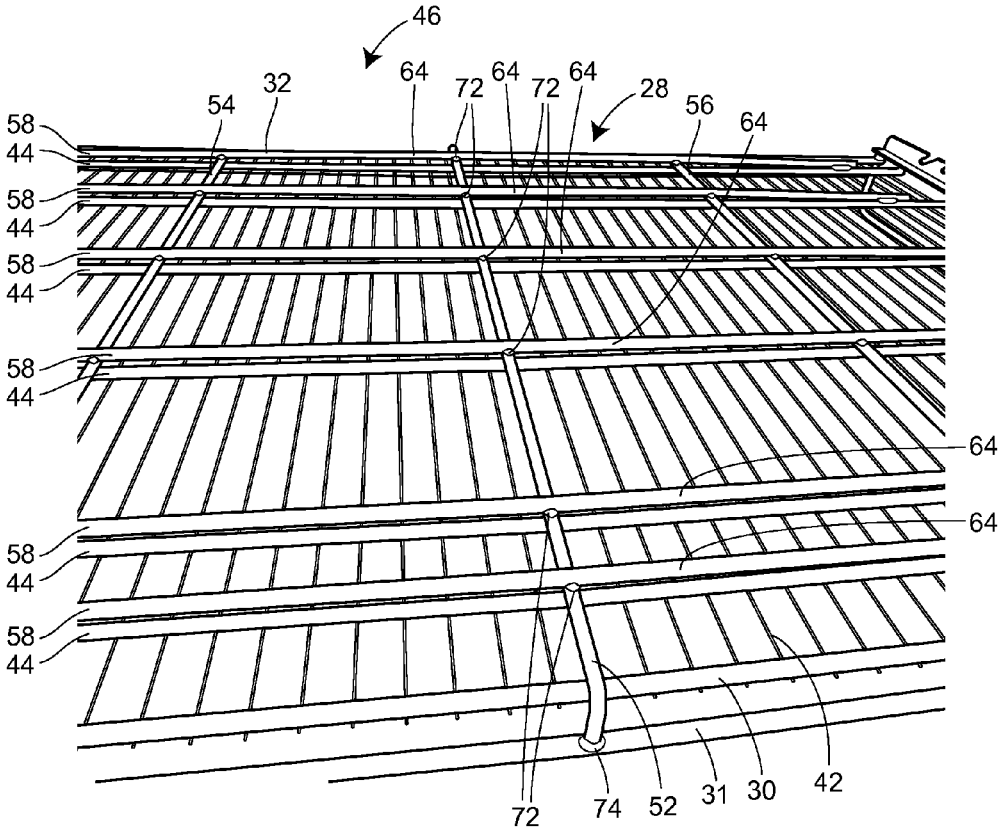
FIG. 5 is a bottom, perspective view of a portion of the extra-wide display shelf, illustrating a portion of the reinforcement system constructed in accordance with the principles of the present disclosure.

Referring now to FIGS. 4 and 5, the middle sections 64 of the reinforcement rails 58 are likewise welded to center, second and third support rails 52, 54, 56. For example, FIG. 4 illustrates two middle sections 64 of two reinforcement rails 58 welded to the center support rail 52 to form two center welds 72. In a similar manner, FIG. 5 further illustrates the two center welds 72 illustrated in FIG. 4, and further shows the remaining four center welds 72 in this example that connect middle sections 64 of the remaining four reinforcement rails 58 to the center or first support rail 52.

FIGS. 4 and 5 further illustrate the end of the first support rail 52 being bent such that it is welded to the second front rail 31 to form a front weld 74. Likewise, and as illustrated in FIG. 2B, a rear end of the first support rail 52 is also bent such that it is welded to a second rear rail 33 to form a rear weld.

A combination of the plurality of support rails 50 welded to corresponding horizontal rails 44 and the plurality of reinforcement rails 58 disposed perpendicular to and under the plurality of support rails 50 of the reinforcement system 48 puts the surface 45 of the shelf 28 in tension. Such tension bends a center region of the shelf 28 in an upward direction when the shelf is unloaded, to offset downward deflection due to the weight of product placed thereon, as illustrated in FIG. 6.

Figure 6:
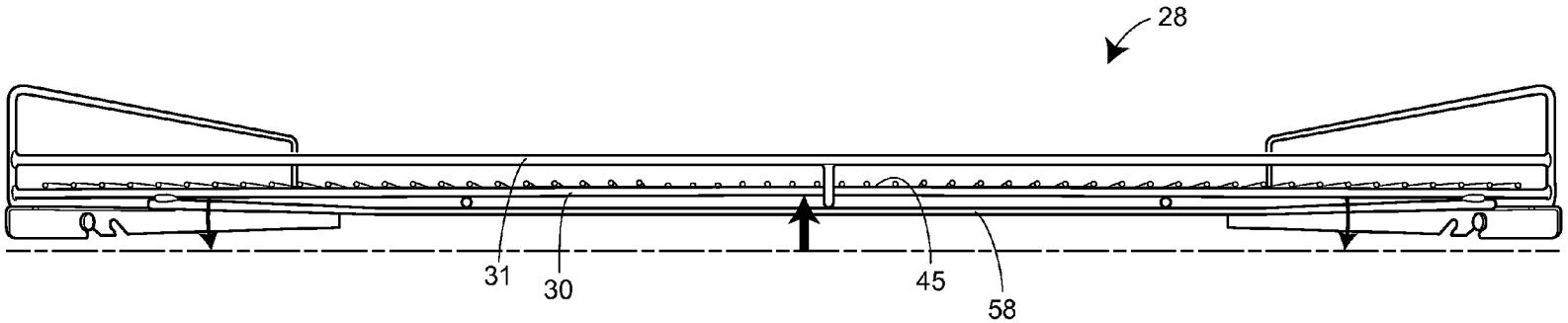
FIG. 6 is a front, perspective view of the extra-wide display shelf disposed within the extra-wide rack, the extra-wide display shelf having the reinforcement system forming a slight upward bow of a center portion of the shelf.

More specifically, FIG. 6 illustrates a front perspective view of the extra-wide display shelf 28 disposed within the extra-wide rack 12. The reinforcement system 48 creates a slight upward bow of a center portion of the surface 45 of the shelf 28 when unloaded, which is further illustrated by both the bolded, upward center arrow and in relation to the phantom horizontal line illustrated below the front rail 30 of the shelf 28 in FIG. 6. The slight upward bow of the center portion of the shelf 28 offsets downward deflection that is caused by placing containers, such as a variety of dairy products, on the surface of the extra-wide display shelf 28. Thus, the reinforcement system 48 fully supports the extra-wide display shelf 28 of an extra-wide gravity-fed display system 10 even when the shelf 28 is fully stocked with the heaviest dairy product.

As will be appreciated, the width of the extra-wide display shelf 28 relates to how much product the shelf 28 may hold and, therefore, how much weight the shelf 28 may withstand. For example, the width of the shelf 28 may be four, five or six feet, for example. In one example, a shelf 28 having a conventional width of three feet can hold about 48 gallons of milk, which equates to about 384 pounds. In another example, a shelf 28 having a width of four feet can hold about 64 gallons of milk, which equates to about 512 pounds. While wire shelving systems without the reinforcement technique and system of the present disclosure are adequate to support loads on the order of 384 pounds without significant bowing, the additional weight of the product that can be supported by a wider shelf would, without adequate reinforcement of the shelf, deflect downwardly to an unacceptable extent. When coupled with the increased distance that products along the sides of the wider shelf are spaced from the center of the shelf, the bowing can result in products tipping and in disrupting flow of products toward the front of the shelf if inclined for use in a gravity-fed manner.

While various embodiments have been described herein, it is understood that the appended claims are not intended to be limited thereto, and may include variations that are still within the literal or equivalent scope of the claims.

What is claimed is:

1. A gravity-fed display system comprising:

a rack having front support legs and rear support legs disposed opposite the front support legs; and at least one display shelf disposed within the rack, the display shelf comprising:

a front rail, a rear rail disposed opposite the front rail, and two side rails disposed between the front rail and the rear rail;

a plurality of cross-rails, wherein each cross-rail extends from the front rail to the rear rail parallel to and between the side rails, along the length of the front and rear rails;

a plurality of horizontal rails disposed under the plurality of cross-rails, wherein each horizontal rail extends from one side rail to the other side rail parallel to and between the front and rear rails, the plurality of cross-rails and the plurality of horizontal rails forming a surface of the shelf, the surface of the shelf having an underside; and a reinforcement system disposed on the underside of the shelf, the reinforcement system including:

a plurality of support rails disposed perpendicular to and under the plurality of horizontal rails, wherein each support rail is welded to at least one horizontal rail; and a plurality of reinforcement rails disposed perpendicular to and under the plurality of support rails, wherein each reinforcement rail includes a first end, a second end disposed opposite the first end, and a middle section disposed between the first and second ends, and wherein the first and second ends of the reinforcement rails are bent in one direction and welded to one horizontal rail of the plurality of horizontal rails and the middle sections of the reinforcement rails are welded to at least one support rail, the reinforcement system thereby bending the surface of the shelf such that a center region of the shelf bows in an upward direction when unloaded to offset downward deflection of the center region of the shelf due to weight of product to be displayed thereon.

2. The gravity-fed display system of claim 1, wherein the plurality of support rails of the display shelf further includes a first support rail disposed at an approximate center of the surface of the shelf, a second support rail and a third support rail, wherein each of the second and third support rails are spaced the same distance from the first support rail on either side of the same.

3. The gravity-fed display system of claim 1, wherein the plurality of horizontal rails includes six horizontal rails and the plurality of reinforcement rails includes six reinforcement rails.

4. The gravity-fed display system of claim 1, wherein the number of horizontal rails is equal to the number of reinforcement rails.

5. The gravity-fed display system of claim 1, wherein the front and rear support legs each include holes to enable one or more display shelves to be placed at any desired height and angle of incline along the legs.

* * * * *